US007497605B1

(12) United States Patent
Pan

(10) Patent No.: US 7,497,605 B1
(45) Date of Patent: Mar. 3, 2009

(54) STRUCTURE OF AUTOMOBILE LIGHT

(76) Inventor: Chi-Hsiang Pan, 9F., No. 26, Alley 119, Lane 103, Sec. 2, Neihu Rd., Taipei City (TW)

( * ) Notice: Subject to any disclaimer, the term of this patent is extended or adjusted under 35 U.S.C. 154(b) by 0 days.

(21) Appl. No.: 11/964,010

(22) Filed: Dec. 25, 2007

(51) Int. Cl.
*F21V 9/00* (2006.01)

(52) U.S. Cl. ..... 362/511; 362/487

(58) Field of Classification Search ..... 362/551, 362/564, 511, 520, 333, 554
See application file for complete search history.

(56) References Cited

U.S. PATENT DOCUMENTS 5,499,168 A * 3/1996 Cochard et al. ..... 362/466
5,594,424 A * 1/1997 Louy et al. ..... 340/815.54
7,419,287 B2 * 9/2008 Gasquet ..... 362/511
2006/0215414 A1 * 9/2006 Lauber ..... 362/511
2006/0268564 A1 * 11/2006 Ruiz ..... 362/511

* cited by examiner

*Primary Examiner*—Ali Alavi
(74) *Attorney, Agent, or Firm*—Leong C. Lei

(57) ABSTRACT

An automobile light includes a base forming a plurality of spaced and arrayed mounting holes and hollow cylinders extending from the base and surrounding the mounting holes respectively; and a plurality of light guide rods each having a front end face forming a cavity and a rear end face forming a curved projection. The light guide rods are respectively received and retained in the hollow cylinders and partially project beyond the mounting hole respectively. With the base fixed to a shielding hood containing therein a light source, the light emitted from the light source is received by and subjected to refraction caused by the light guide rods to her spread the light in the form of multiple light beams for simulating multiple beam effect provided by simultaneous lighting of multiple light-emitting diodes.

3 Claims, 6 Drawing Sheets

STRUCTURE OF AUTOMOBILE LIGHT

BACKGROUND OF THE INVENTION (a) Technical Field of the Invention

The present invention provides a structure of automobile lights, and in particular to an automobile light that is constructed to simulate the multiple beam effect provided by simultaneous lighting of multiple light-emitting diodes (LEDs).

(b) Description of the Prior Art

An automobile is provided with automobile lights, such as tail lights and brake lights, both requiring sufficient brightness to signal the drivers of following automobiles to take immediate action when necessary in order to avoid the occurrence of traffic accidents. Thus, the brightness of an automobile light is of vital importance. With the successful development of high-brightness light-emitting diodes (LEDs), various automobile lights that are currently available from the commercial market are now constructed with the LEDs as a light source thereof. By means of the extremely high brightness provided by using multiple LEDs, traffic safety can be secured and a particular dazzling and bright visual effect can be realized.

A conventional LED based automobile light, of which an example is shown in FIG. 1 of the attached drawings, comprises a base 1 in which a plurality of spaced and arrayed through holes 11 is defined. To comply with the curved shape of an automobile body, the holes 11 are arranged in a step-like configuration. In these holes 11, LEDs 12 are fit and fixed and the LEDs 12 are electrically connected to a driving circuit whereby the LEDs 12 can be selectively energized by the driving circuit to give off light. However, the high-brightness LEDs that are available from the market are of expensive costs so that using a great number of the high-brightness LEDs in an automobile light may substantially increase the costs of the automobile light.

Thus, it is desired to provide an automobile light that is of low costs but having a lighting effect similar to a multiple LED automobile light.

SUMMARY OF THE INVENTION

The primary purpose of the present invention is to provide an automobile light which comprises an arrangement of a plurality of light guide rods to provide a lighting effect similar to a multiple light beam effect displayed by multiple light-emitting diodes (LEDs) and thus a particular dazzling and bright lighting effect can be obtained.

In accordance with the present invention, an automobile light comprises a base forming a plurality of spaced and arrayed mounting holes therein and a hollow cylinder extending from the base and surrounding a respective one of the mounting holes; and a plurality of light guide rods respectively received and retained in the hollow cylinders and partially projecting beyond and exposed through the respective mounting hole, whereby with the base fixed to a shielding hood containing therein a light source, the light emitted from the light source is received by and subjected to refraction caused by the light guide rods to further spread the light in the form of multiple light beams for simulating multiple beam effect provided by simultaneous lighting of multiple light-emitting diodes.

In the automobile light in accordance with the present invention, each light guide rod comprises a front extension section having a front end face forming a recessed cavity and a rear extension section having a rear end face forming a curved projection. The light given off by the light source is focused by the curved projection and is subjected to refraction caused by the cavity to thereby exhibit the multiple light beams.

In the automobile light in accordance with the present invention, the light guide rods can be of different colors to provide light beams of different colors as desired.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
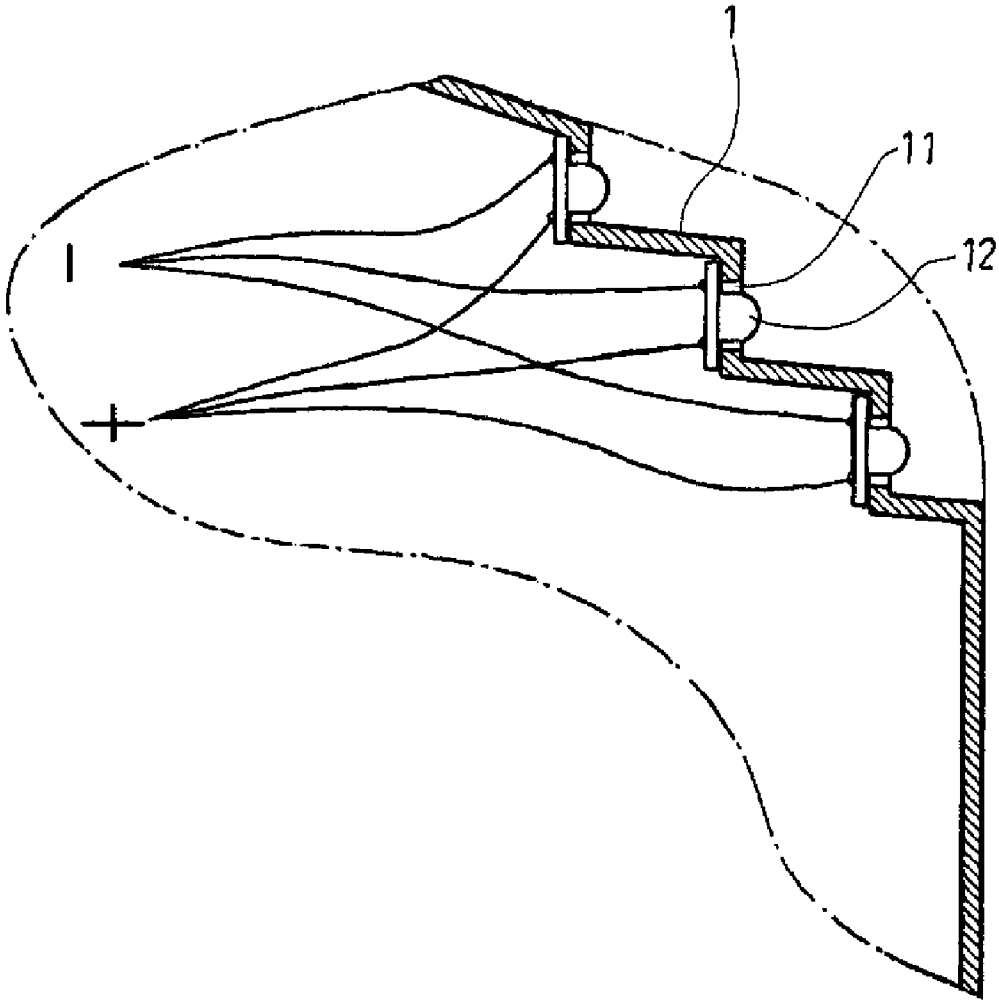
PRIOR ART FIG . 1
FIG. 1 is a cross-sectional view of a portion of a conventional automobile light.
Figure 2:
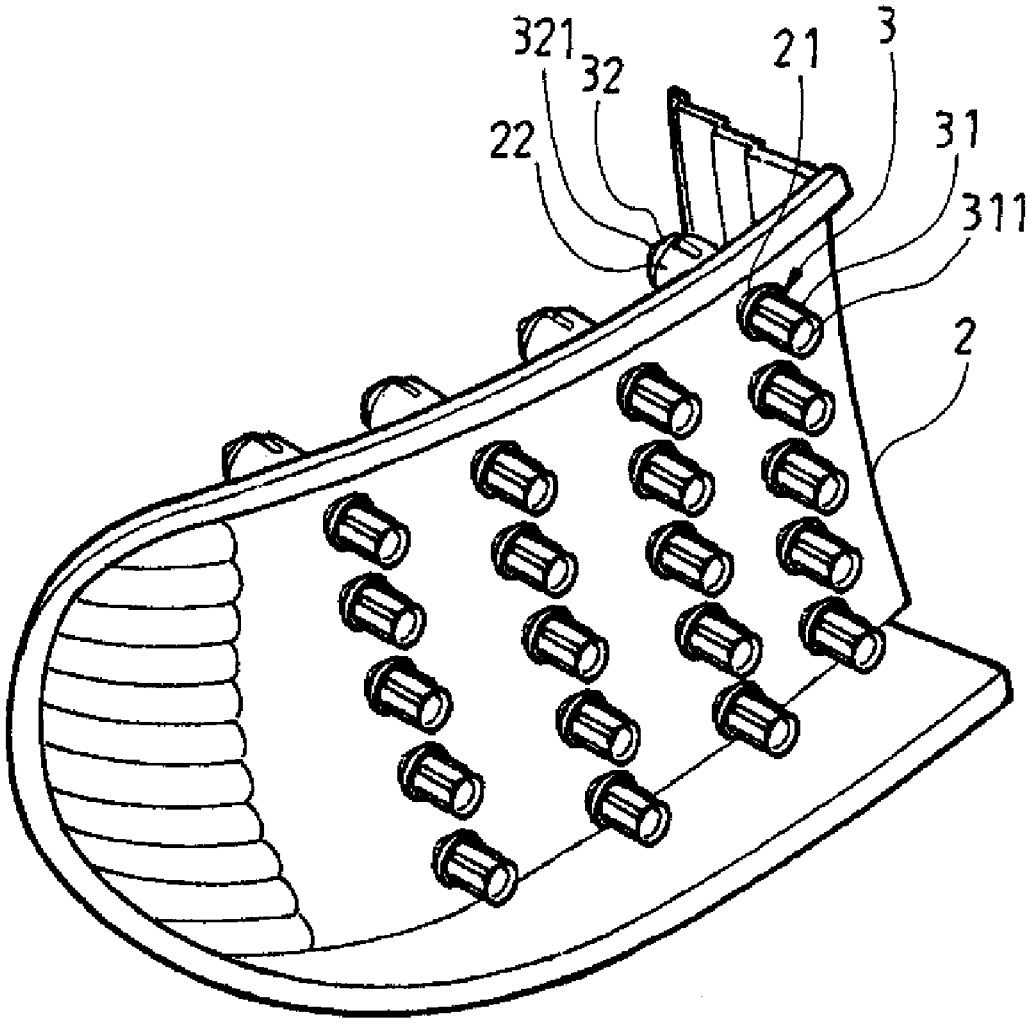
FIG. 2 is a perspective view of an automobile light constructed in accordance with an embodiment of the present invention.
Figure 3:
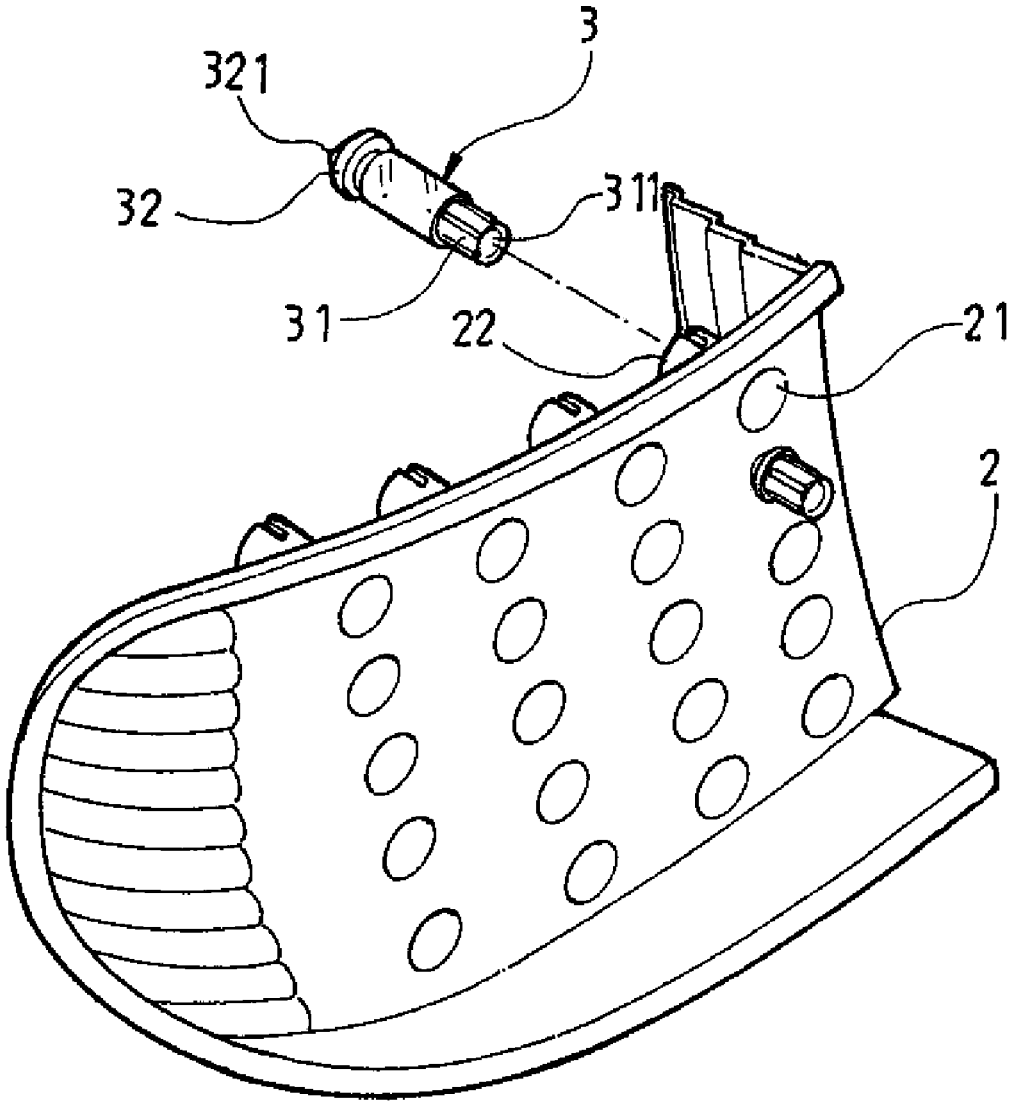
FIG. 3 is an exploded view of the automobile light of the present invention.
Figure 4:
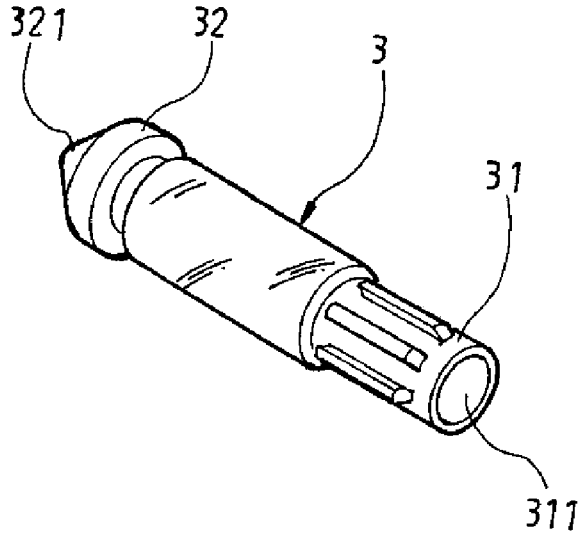
FIG. 4 is a perspective view of a light guide rod of the automobile light of the present invention.
Figure 5:
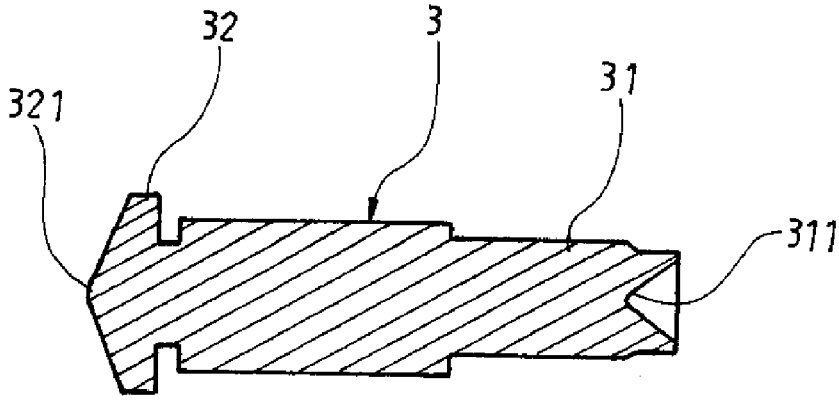
FIG. 5 is a cross-sectional view of the light guide rod of the present invention.

With reference to the drawings, and in particular to FIGS. 2 and 3, together with FIGS. 4 and 5, an automobile light constructed in accordance with the present invention is shown, which in the embodiment illustrated, is applicable to an automobile tail light, comprising a base 2 in which a plurality of mounting holes 21 is formed in a spaced and arrayed manner. If desired, the mounting holes 21 can be arranged in a step-like manner, but not necessary to be so. Extending from an inner surface of the base 2 and around each mounting hole 21 is a hollow cylinder 22 having a predetermined length.

A plurality of light guide rod 3, in the form of a cylinder, preferably a solid cylinder, is respectively received in the hollow cylinders 22 of the mounting holes 21. Each light guide rod 3 comprises a diameter-reduced front extension section 31 having a front end face in which a recessed cavity 311 is formed and a diameter-expanded rear extension section 32 having a rear end face forming a curved projection 321, preferably in the form of a cone.

A shielding hood 4 supports and retains the base 2 and contains therein a lamp bulb 41 or other suitable light source.

To assemble, each light guide rod 3 is fit into the respective hollow cylinder 22 of the base 2 with the front extension 31 thereof in such a way that the front extension 31 partially projects beyond and is thus exposed through the mounting hole 21. The base 2 is then attached to the shielding hood 4, which is in turn mounted to an automobile body (not shown). The lamp bulb or light source 41 is lit to give up light, which is received by and subjected to refraction caused by the light guide rods 3 to emit in the form of a plurality of beams to thereby simulate the multi-beam lighting provided by simultaneous lighting of multiple light-emitting diodes (LEDs).

Figure 6:
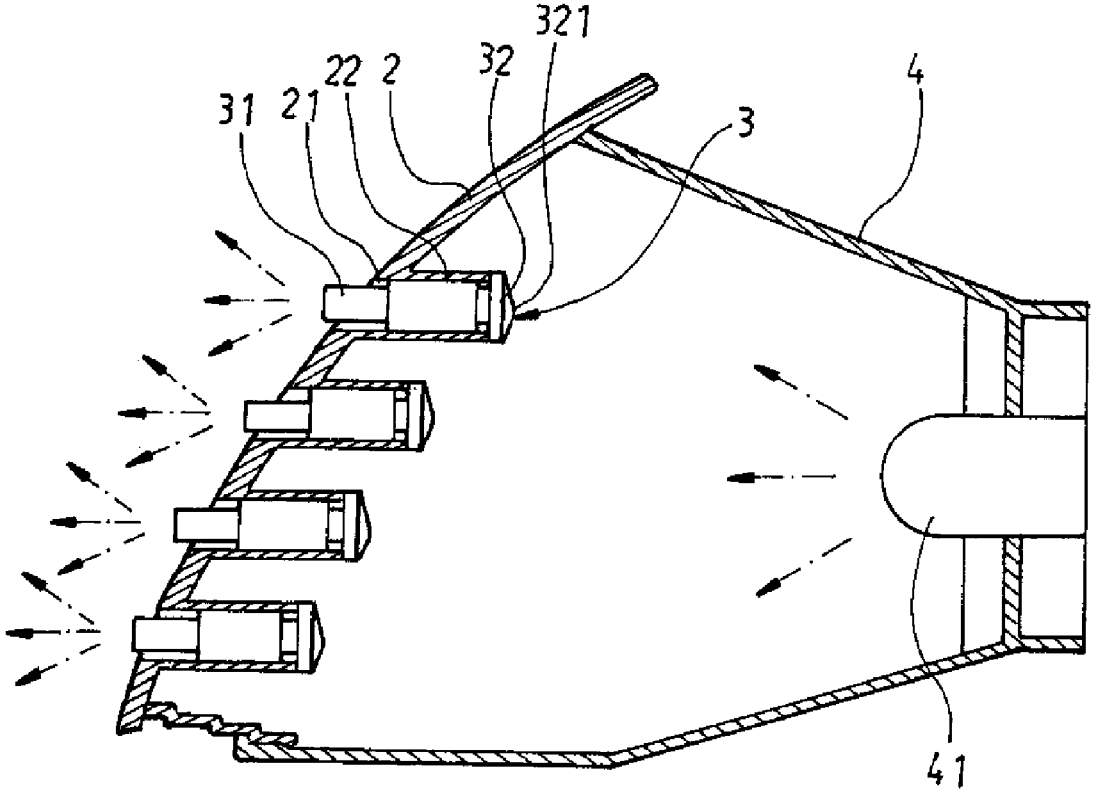
FIG. 6 is a cross-sectional view of the automobile light of the present invention.

Also referring to FIG. 6, in the assembly of the automobile light of the present invention, the light guide rods 3 are received and fixed in the hollow cylinders 22 of the base 2 with the front end faces of the front extensions 31 of the light guide rods 3 projecting beyond and/or exposed through the mounting holes 21 respectively. The base 2 is attached to the shielding hood 4 in such a way that a light convergence space is defined between the base 2 and the shielding hood 4. When the lamp bulb 41 or the light source is energized to give off light, the light uniformly irradiates all the light guide rods 3. By means of the light focusing provided by the curved projections 321 of each light guide rod 3 and light refraction induced inside the cavity 311 of the light guide rod 3, the light is widely spread outwards and a plurality of light beams is shown thereby simulating the multiple beam effect provided by simultaneous lighting of multiple LEDs and realizing a particular dazzling and bright visual effect. Further, if desired, the light guide rods 3 can be made with different colors. For example, for a turning signal light, the light guide rods 3 are of yellow color, while for a brake light, the light guide rods 3 are red. Thus, the light beam emitted from the automobile light in accordance with the present invention can be of different colors as desired.

Figure 7:
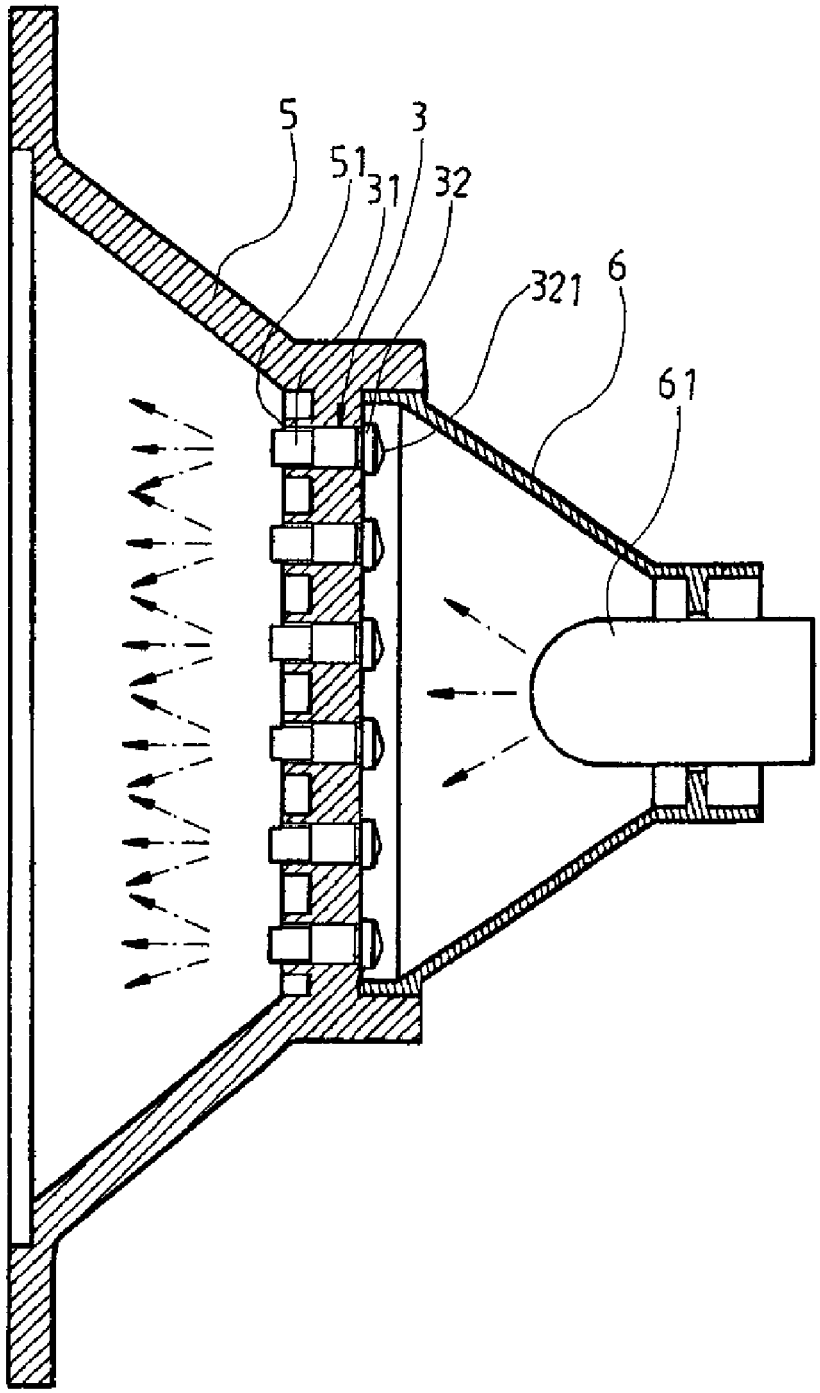
FIG. 7 is a cross-sectional view of an automobile light constructed in accordance with another embodiment of the present invention.

FIG. 7 shows a different embodiment of the automobile light in accordance with the present invention, which is applicable to for example an automobile head light comprising a base 5 in which a plurality of spaced and arrayed mounting holes 51 is formed. The mounting holes 51 receive therein a plurality of light guide rods 3 respectively with a front extension section or fitting section 31 of each light guide rod 3 fitting into the respective mounting hole 51 and partially projecting beyond the mounting hole 51 for exposing. A shielding hood 6 supports and retains the base 5 and contains therein a lamp bulb 61. Thus, when the shielding hood 6, with the base 5 mounted thereto, is mounted to an automobile body (not shown) and when the lamp bulb 6 is lit to give off light, the light is received by and is subjected to refraction caused by the light guide rods 3 to show a plurality of light beams spread outward thereby simulating the effect of multiple beam lighting provided by simultaneous lighting of multiple LEDs.

To summarize, the present invention provides an automobile light that is comprised of a base forming a plurality of mounting holes to receive and retain a plurality of light guide rods for simulating the multiple beam effect provided by simultaneous lighting of multiple LEDs, whereby a particular dazzling and bright lighting effect can be realized.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An automobile light comprising:

a base forming a plurality of spaced mounting holes thereon, a hollow cylinder extending from the base and surrounding a respective one of the mounting holes;

a plurality of light guide rods respectively received in hollow cylinders and partially projecting beyond and exposed through the respective mounting hole; and a shielding hood supporting and retaining the base and containing therein a light source;

wherein the base is mounted to the shielding hood and the shielding hood is adapted to fix to an automobile body and wherein the light source gives off light which is received by and subjected to refraction caused by the light guide rods to further spread the light in the form of multiple light beams for simulating multiple beam effect provided by simultaneous lighting of multiple light-emitting diodes.

2. The automobile light as claimed in claim 1, wherein each light guide rod comprises a front extension section having a reduced diameter and having a front end face forming a recessed cavity and a rear extension section having an expanded diameter and having a rear end face forming a curved projection, and wherein the light given off by the light source is focused by the curved projection and is subjected to refraction caused by the cavity to thereby exhibit the multiple light beams.

3. The automobile light as claimed in claim 1, wherein the light guide rods are of different colors to provide light beams of different colors.

* * * * *